US009905380B2

(12) United States Patent
Huang et al.

(10) Patent No.: US 9,905,380 B2
(45) Date of Patent: Feb. 27, 2018

(54) MAGNETIC TYPE KEYBOARD AND MAGNETIC KEY THEREOF

(71) Applicant: PRIMAX ELECTRONICS LTD., Taipei (TW)

(72) Inventors: Wei-Yung Huang, Taipei (TW); Hsien-Tsan Chang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 15/227,760

(22) Filed: Aug. 3, 2016

(65) Prior Publication Data

US 2017/0330709 A1 Nov. 16, 2017

(30) Foreign Application Priority Data

May 13, 2016 (TW) ..... 105114935 A

(51) Int. Cl.
*H01H 13/7065* (2006.01)

(52) U.S. Cl.
CPC ..... *H01H 13/7065* (2013.01); *H01H 2221/04* (2013.01); *H01H 2223/042* (2013.01)

(58) Field of Classification Search
CPC ..... H01H 13/7065; H01H 2221/04; H01H 2223/042; H01H 13/84; H01H 13/14
USPC ..... 200/5 A; 341/34
See application file for complete search history.

(56) References Cited

U.S. PATENT DOCUMENTS 5,977,888 A * 11/1999 Fujita ..... H01H 13/705 200/12
2008/0000766 A1* 1/2008 Honmatsu ..... H01H 13/84 200/5 A
2012/0299832 A1* 11/2012 Peterson ..... G06F 3/0202 345/168
2014/0231234 A1* 8/2014 Hsu ..... H01H 13/52 200/5 A
2014/0367236 A1* 12/2014 Chiang ..... H01H 13/705 200/344
2015/0101917 A1* 4/2015 Yen ..... H01H 13/84 200/5 A
2015/0243456 A1* 8/2015 Hsu ..... H01H 13/20 200/344

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A magnetic key includes a keycap, a base plate, a membrane circuit member, a frame, a first magnetic element, a second magnetic element, and a third magnetic element. The frame includes a first concave structure, a second concave structure and an opening. An accommodation space is defined by the frame and a first protrusion structure and a second protrusion structure of the base plate. The first magnetic element is received within the first concave structure. The second magnetic element is received within the second concave structure. The third magnetic element is disposed under the keycap and accommodated within the accommodation space. In response to a first magnetic force between the first and third magnetic elements and a second magnetic force between the second and third magnetic elements, the keycap is protruded out of the opening.

12 Claims, 8 Drawing Sheets

MAGNETIC TYPE KEYBOARD AND MAGNETIC KEY THEREOF

FIELD OF THE INVENTION

The present invention relates to a magnetic type keyboard and a magnetic key, and more particularly to a magnetic type keyboard and a magnetic key using a lateral or horizontal magnetic force to return a keycap to its original position.

BACKGROUND OF THE INVENTION

As known, computers such as desktop computer (e.g., personal computers) or notebook computers become essential tools in our daily lives. Moreover, keyboards are important input devices of computers. Via the keyboards, users can input characters or perform control operations. Generally, a keyboard comprises plural keys. These keys are located at specified positions. Moreover, many electronic devices or electrical operation devices are equipped with keys that are used as operation interfaces of performing various designated functions.

For allowing users to perform the input and control operations, the keys of the keyboard are specially designed. That is, in response to a single depressing action, the key is returned to its original position and a triggering signal is generated in response to the depressing action. As for the conventional keyboards, the keys are classified according to the types of the switches in the keys. For example, the keys are classified into some types, including mechanical keys, membrane keys, conductive rubber keys and contactless electrostatic capacitive keys. The use lives, tactile feels and fabricating cost for different types of keys are usually different.

With increasing development of science and technology, the trends of designing electronic devices are toward light weightiness and slimness. That is, the thickness of the key of the electronic device is gradually reduced. However, for providing the position-returning function, the overall volume of the conventional key is still large. Moreover, the conventional key has some drawbacks such as the stuck key problem, the impaired tactile feel or the high fabricating cost. For solving these drawbacks, a magnetic type keyboard with magnetic keys is introduced into the market. The magnetic keys can be applied to the slim-type electronic devices. Moreover, the magnetic keys can provide special depressing feels to users. For example, the associated technologies are disclosed in Chinese utility model patent Nos. CN103065846 and CN204204708.

The structure features and position-returning principles of the magnetic key of the conventional magnetic type keyboard will be described as follows. At least two magnets are located at two opposite sides of an outer periphery of a keycap, and at least two magnets are formed on a keyboard frame at the positions corresponding to the magnets on the outer periphery of the keycap in the vertical direction. Since the magnets on the outer periphery of the keycap and the magnets on the keyboard frame are magnetically attracted by each other in the vertical direction, the keycap can be returned to its original position after the keycap is depressed. The magnetic attraction force generated by these magnets is in parallel with the direction of depressing the keycap. Moreover, the magnetic attraction between two magnets can be replaced by the magnetic attraction between a magnet and a paramagnetic material.

Since the keycap of the key is depressed in the vertical direction, it is necessary to reserve a proper space between the keycap and the keyboard base so as to accommodate the depressed keycap. As mentioned above, the magnetic key of the conventional magnetic type keyboard is equipped with magnets on the outer periphery of the keycap magnets on the keyboard frame along the direction of depressing the keycap. Moreover, the buffering space for accommodating the depressed keycap is required. In other words, the overall thickness and volume of the key structure are very large. The large thickness and volume of the key structure are detrimental to the slimness of the keyboard or the electronic device.

SUMMARY OF THE INVENTION

For overcoming the drawbacks of the conventional technologies, the present invention provides a magnetic type keyboard and a magnetic key. The magnetic key uses a lateral or horizontal magnetic force to return a keycap to its original position. Since the thickness and volume of the magnetic key are effectively reduced, the magnetic type keyboard and the magnetic key can meet the slimness requirement.

In accordance with an aspect of the present invention, there is provided a magnetic type keyboard. The magnetic type keyboard includes plural magnetic keys. Each magnetic key includes a keycap, a base plate, a membrane circuit member, a frame, a first magnetic element, a second magnetic element, and a third magnetic element. The keycap can be depressed. The membrane circuit member is disposed over the base plate. The frame is disposed over the base plate and the membrane circuit member. The frame includes a first concave structure, a second concave structure and an opening. The keycap is movably inserted in the opening. The frame has an accommodation space. The first magnetic element is disposed on the base plate and received within the first concave structure. The second magnetic element is disposed on the base plate and received within the second concave structure. The third magnetic element is disposed under the keycap and accommodated within the accommodation space. In response to a first magnetic force between the third magnetic element and the first magnetic element and a second magnetic force between the third magnetic element and the second magnetic element, the keycap is driven to be protruded out of the opening.

In accordance with another aspect of the present invention, there is provided a magnetic key. Each magnetic key includes a keycap, a base plate, a membrane circuit member, a frame, a first magnetic element, a second magnetic element, and a third magnetic element. The keycap can be depressed. The membrane circuit member is disposed over the base plate. The frame is disposed over the base plate and the membrane circuit member. The frame includes a first concave structure, a second concave structure and an opening. The keycap is movably inserted in the opening. The frame has an accommodation space. The first magnetic element is disposed on the base plate and received within the first concave structure. The second magnetic element is disposed on the base plate and received within the second concave structure. The third magnetic element is disposed under the keycap and accommodated within the accommodation space. In response to a first magnetic force between the third magnetic element and the first magnetic element and a second magnetic force between the third magnetic element and the second magnetic element, the keycap is driven to be protruded out of the opening.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

Figure 1:
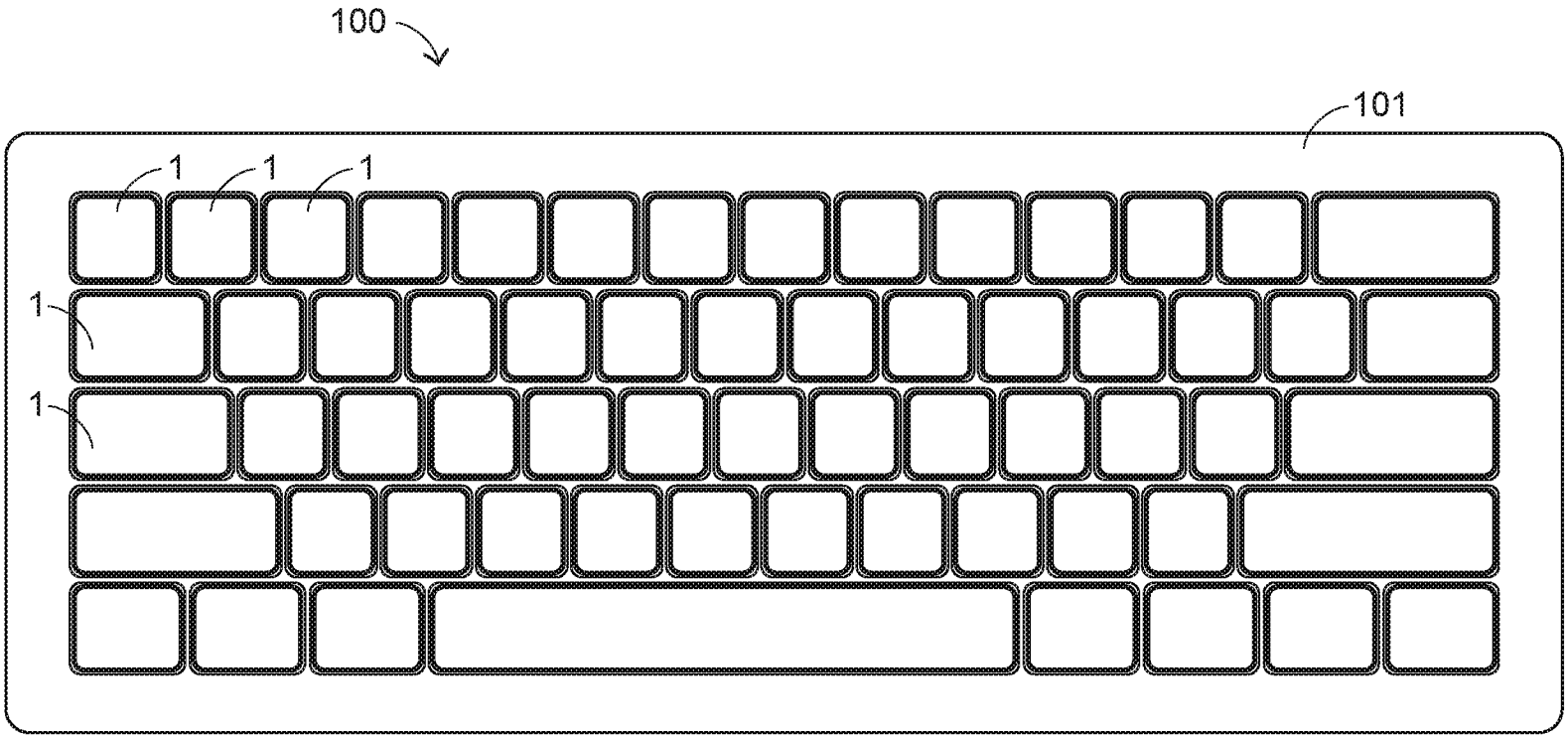
FIG. 1 is a schematic top view illustrating a magnetic type keyboard according to an embodiment of the present invention.

Hereinafter, an example of a magnetic type keyboard will be illustrated with reference to FIG. 1. FIG. 1 is a schematic top view illustrating a magnetic type keyboard according to an embodiment of the present invention. As shown in FIG. 1, the magnetic type keyboard 100 comprises plural magnetic keys 1. These magnetic keys 1 are arranged at the designated positions according to characters or functions. The magnetic type keyboard 100 of this embodiment can be applied to a computer host or an electronic device. Via the magnetic type keyboard 100, users can input characters or perform control operations. Moreover, the sizes and shapes of the magnetic keys 1 shown in FIG. 1 can be identical or different according to the practical requirements.

In accordance with a feature of the present invention, the keycaps of these magnetic keys 1 are returned to their positions according to magnetism. Particularly, the position-returning function of the keycap is achieved according to the magnetic attraction of magnets. In this present invention, the key of the keyboard is taken as an example. It is noted that the concepts of the present invention can be applied to the equipment or device with the key having the position-returning function in response to a single depressing action.

Figure 2:
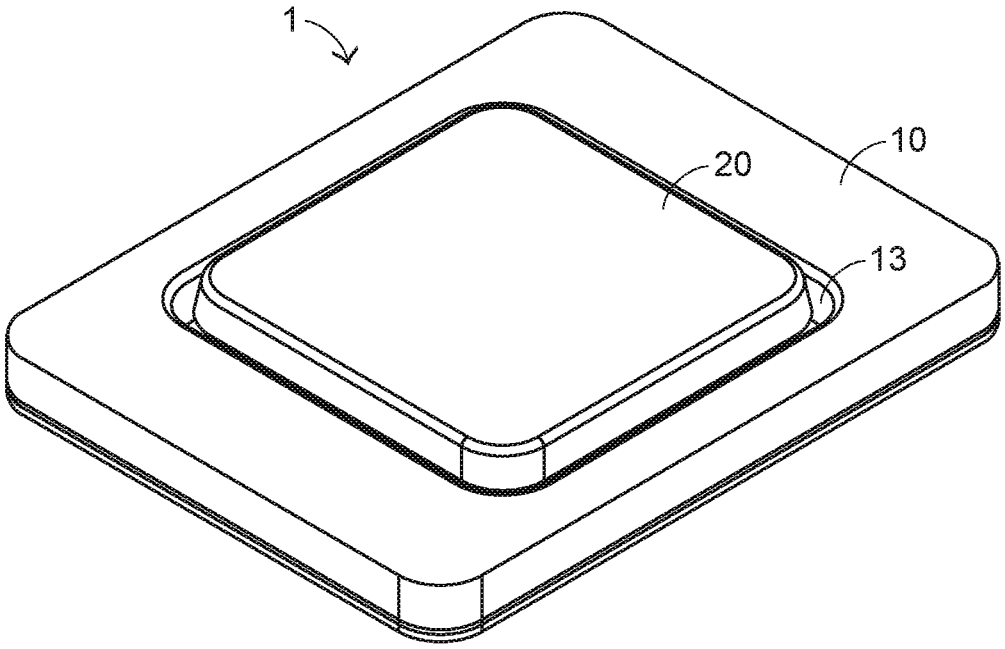
FIG. 2 is a schematic perspective view illustrating a magnetic key of the magnetic type keyboard of FIG. 1.

FIG. 2 is a schematic perspective view illustrating a magnetic key of the magnetic type keyboard of FIG. 1. Please refer to FIGS. 1 and 2. The magnetic type keyboard 100 comprises a casing 101. Each of the magnetic keys 1 comprises a frame 10. Moreover, all magnetic keys 1 are installed on the casing 101, or the frame 10 of each magnetic key 1 is considered as a part of the casing 101. Each frame 10 has an opening 13. Each magnetic key 1 comprises a keycap 20. The keycap 20 can be depressed by the user. In addition, the keycap 20 is movably inserted in the corresponding opening 13.

Figure 3A:
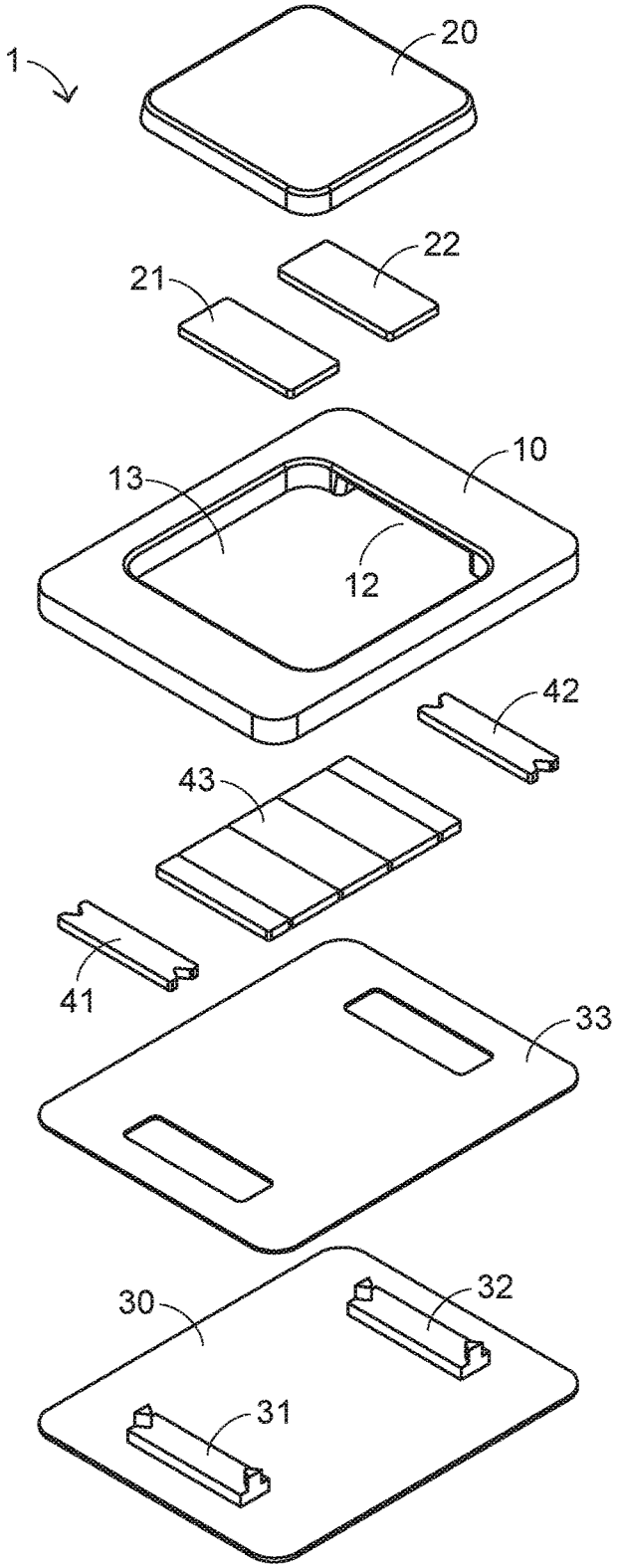
FIG. 3A is a schematic exploded view illustrating the magnetic key of FIG. 2.
Figure 3B:
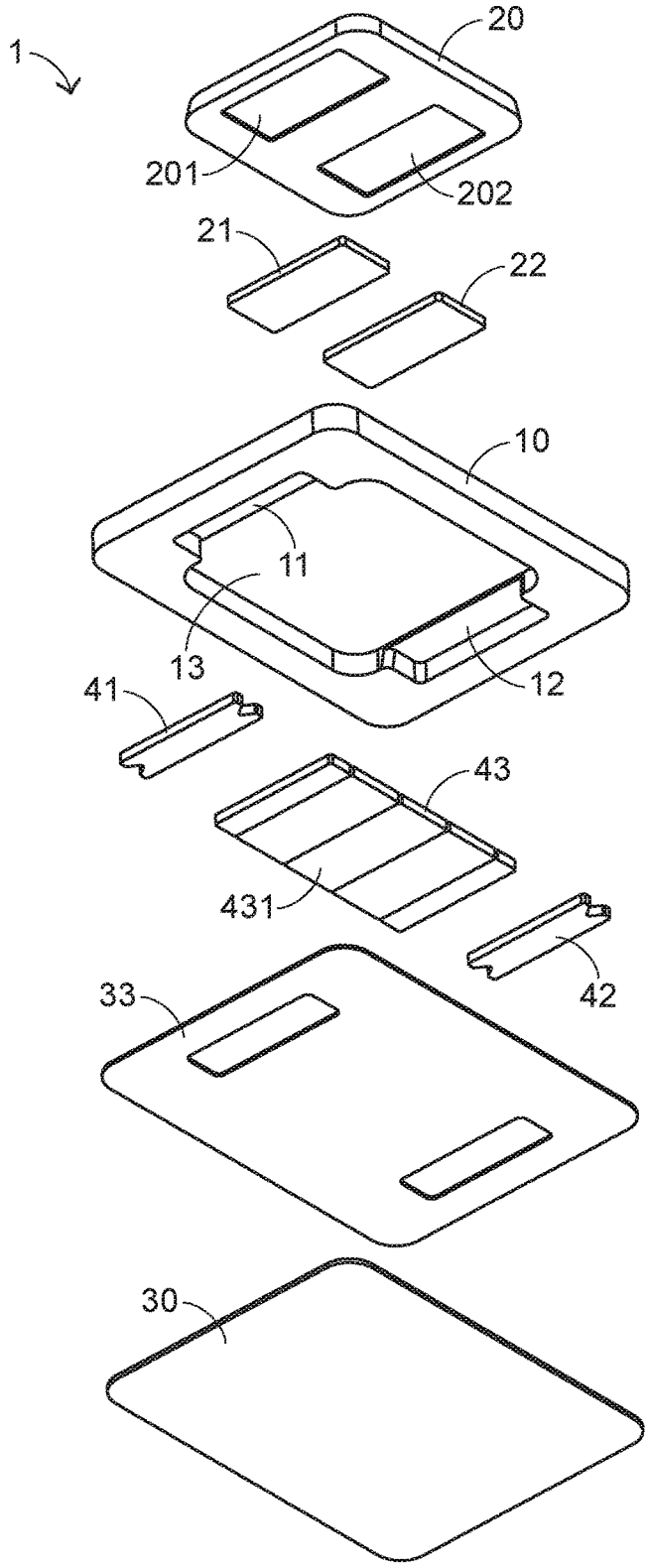
FIG. 3B is a schematic exploded view illustrating the magnetic key of FIG. 3A and taken along another viewpoint.
Figure 4:
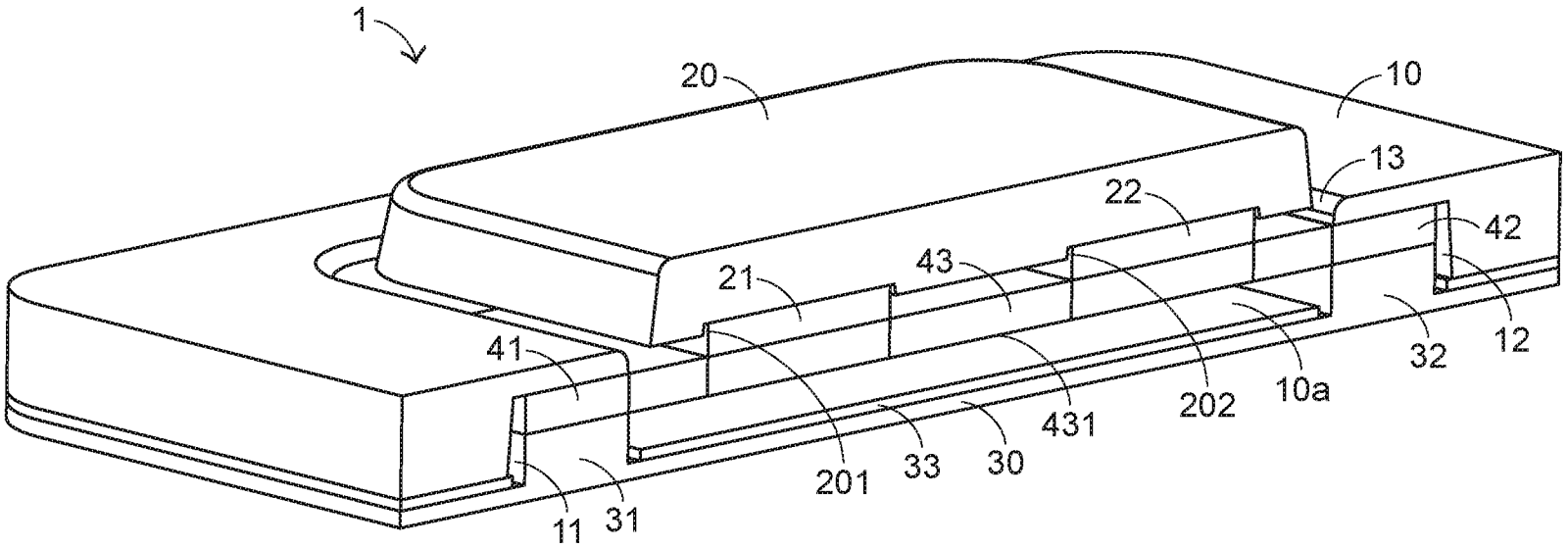
FIG. 4 is a schematic cutaway view illustrating the magnetic key of FIG. 2.
Figure 5A:
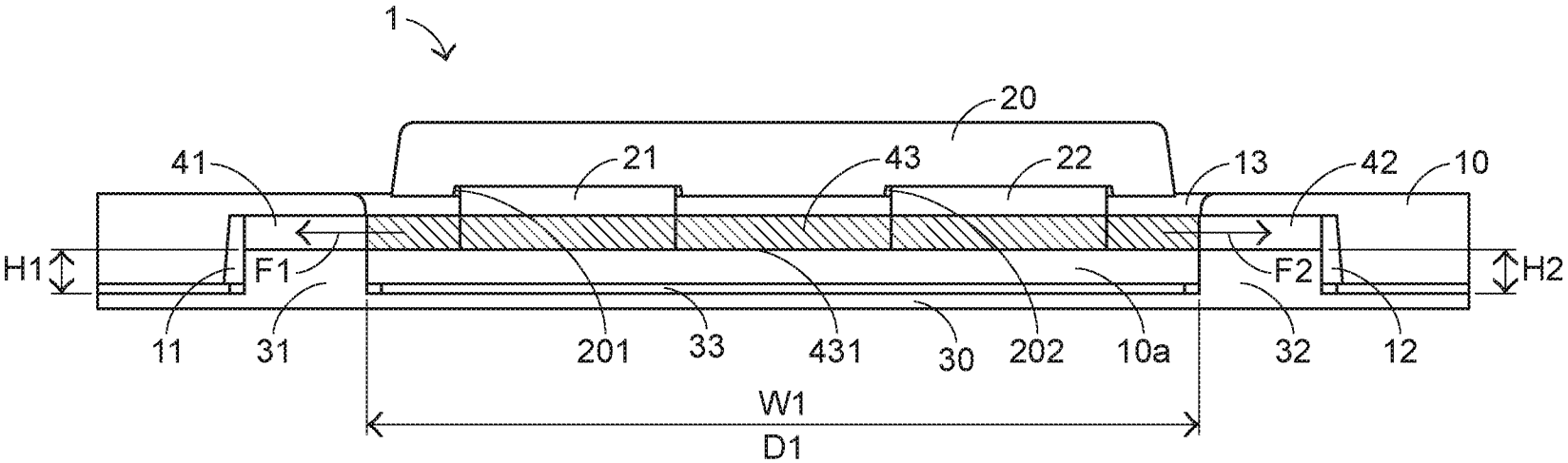
FIG. 5A is a schematic side cross-sectional view illustrating the magnetic key of FIG. 2, in which the magnetic key is in a non-depressed state.
Figure 5B:
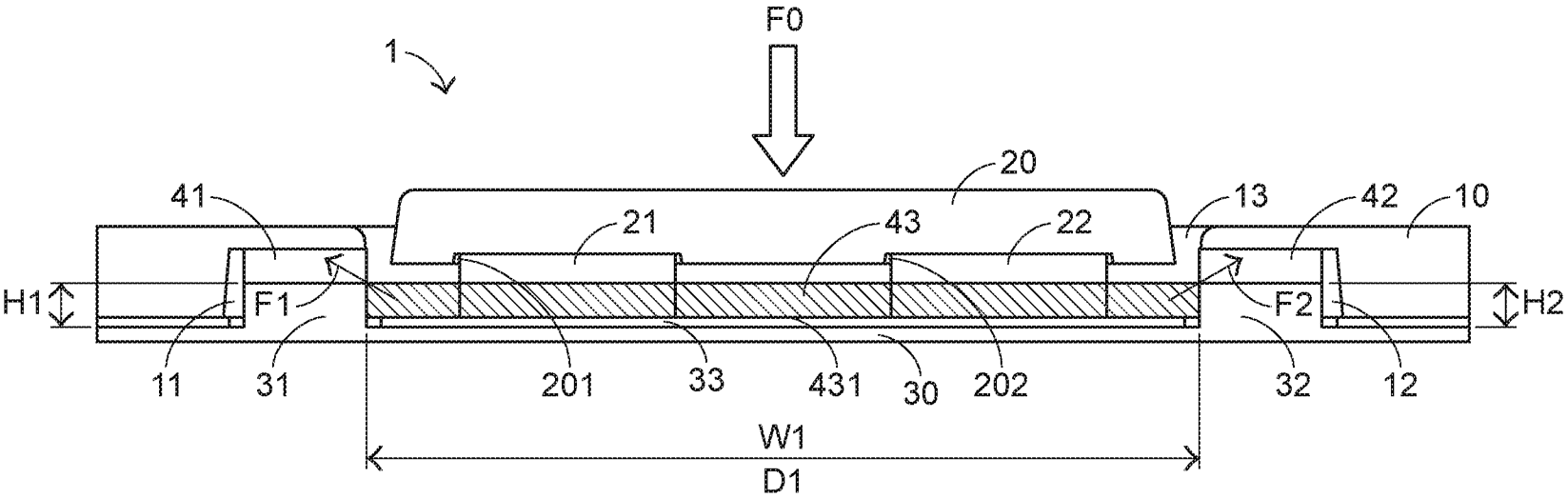
FIG. 5B is a schematic side cross-sectional view illustrating the magnetic key of FIG. 2, in which the magnetic key is in a depressed state.

Please refer to FIGS. 3A, 3B, 4, 5A and 5B. FIG. 3A is a schematic exploded view illustrating the magnetic key of FIG. 2. FIG. 3B is a schematic exploded view illustrating the magnetic key of FIG. 3A and taken along another viewpoint. FIG. 4 is a schematic cutaway view illustrating the magnetic key of FIG. 2. FIG. 5A is a schematic side cross-sectional view illustrating the magnetic key of FIG. 2, in which the magnetic key is in a non-depressed state. FIG. 5B is a schematic side cross-sectional view illustrating the magnetic key of FIG. 2, in which the magnetic key is in a depressed state.

As shown in these drawings, the magnetic key 1 further comprises a base plate 30, a membrane circuit member 33, a first magnetic element 41, a second magnetic element 42, a third magnetic element 43, and two positioning elements 21 and 22. The membrane circuit member 33 is disposed over the base plate 30. The frame 10 is disposed over the base plate 30 and the membrane circuit member 33. The positioning elements 21 and 22 are disposed under the keycap 20. The base plate 30 comprises a first protrusion structure 31 and a second protrusion structure 32. The frame 10 further comprises a first concave structure 11 and a second concave structure 12. The first concave structure 11 and the second concave structure 12 correspond to the first protrusion structure 31 and the second protrusion structure 32, respectively. During the process of assembling the magnetic key 1, the first concave structure 11 and the second concave structure 12 are respectively aligned with the first protrusion structure 31 and the second protrusion structure 32, and an accommodation space 10*a* is defined by the frame 10, the first protrusion structure 31 and the second protrusion structure 32 collaboratively. The opening 13 is in communication with the accommodation space 10*a*. Moreover, the first concave structure 11 and the second concave structure 12 are on two opposite sides of the accommodation space 10*a*.

Moreover, the first magnetic element 41 is disposed on the first protrusion structure 31 and received within the first concave structure 11, and the second magnetic element 42 is disposed on the second protrusion structure 32 and received within the second concave structure 12. In this embodiment, the height H1 of the first protrusion structure 31 and the height H2 of the second protrusion structure 32 are equal. That is, the distance between the first magnetic element 41 and the base plate 30 (or the membrane circuit member 33) and the distance between the second magnetic element 42 and the base plate 30 (or the membrane circuit member 33) are equal. In case that the sizes or thicknesses of the first magnetic element 41 and the second magnetic element 42 are identical, the magnetic influence of the first magnetic element 41 on the accommodation space 10*a* and the magnetic influence of the second magnetic element 42 on the accommodation space 10*a* are substantially identical.

Moreover, it is important to precisely position the distance or height. For allowing the third magnetic element 43 to effectively position the first magnetic element 41 and the second magnetic element 42, the magnetic key 1 further comprises the two positioning elements 21 and 22. The positioning elements 21 and 22 are fixedly embedded within recesses 201 and 202 that are formed in a bottom surface of the keycap 20. The third magnetic element 43 is disposed under the positioning elements 21 and 22. For example, by adjusting the thicknesses of the positioning elements 21 and 22 between the keycap 20 and the third magnetic element 43, the magnetic influences between these magnetic elements 41, 42 and 43 can be correspondingly controlled. Consequently, the key 20 can be smoothly protruded out of the keycap 20 to be depressed by the user.

Moreover, since the keycap 20 is movably inserted in the opening 13, the size of the keycap 20 is smaller than the size of the opening 13. Preferably, the width W1 of the third magnetic element 43 is equal to the distance D1 between the first magnetic element 41 and the second magnetic element 42. Consequently, when the keycap 20 is returned to its original position or the keycap 20 is in a non-depressed position, the purpose of effectively fixing the keycap 20 and avoiding falling down the keycap 20 can be achieved. After the positioning elements 21 and 22 and the third magnetic element 43 under the keycap 20 are placed in the accommodation space 10*a*, a first magnetic force F1 between the third magnetic element 43 and the first magnetic element 41 and a second magnetic force F2 between the third magnetic element 43 and the second magnetic element 42 are generated. In response to the first magnetic force F1 and the second magnetic force F2, the keycap 20 is driven to be protruded out of the opening 13.

In an embodiment, the first magnetic element 41, the second magnetic element 42 and the third magnetic element 43 are magnets, and the positioning elements 21 and 22 are made of a paramagnetic material. The paramagnetic material is a material that is magnetically attracted in the presence of a magnetic field of a magnet. For example, the paramagnetic material is a metallic material. Consequently, after the positioning elements 21 and 22 are fixedly embedded within the keycap 20, the third magnetic element 43 and the positioning elements 21 and 22 are magnetically attracted by each other, and the third magnetic element 43 is fixed on the bottom surfaces of the positioning elements 21 and 22.

As mentioned above, the first magnetic element 41, the second magnetic element 42 and the third magnetic element 43 are magnets. For generating the first magnetic force F1 and the second magnetic force F2, unlike poles of the first magnetic element 41, the second magnetic element 42 and the third magnetic element 43 are arranged beside each other. For example, the south pole of the first magnetic element 41 faces the north pole of the third magnetic element 43, and the north pole of the second magnetic element 42 faces the south pole of the third magnetic element 43. Please refer to FIGS. 4 and 5A. When the keycap 20 is not depressed, the third magnetic element 43 is magnetically attracted by the first magnetic element 41 and the second magnetic element 42 in response to the first magnetic force F1 and the second magnetic force F2.

Please refer to FIG. 5B. While a depressing force F0 exerted on the keycap 20 overcomes the first magnetic force F1 and the second magnetic force F2, the third magnetic element 43 is moved relative to the first magnetic element 41 and the second magnetic element 42. Consequently, the keycap 20 is moved toward the base plate 30 or the accommodation space 10*a* is shrunken. For moving the third magnetic element 43 downwardly, the width of the accommodation space 10*a* is larger than or equal to the width W1 of the third magnetic element 43. In this embodiment, an electrically-conductive structure 431 is formed on a bottom surface of the third magnetic element 43. For example, the bottom surface of the third magnetic element 43 is coated with a thin layer of electrically conductive material. As the keycap 20 is depressed by the user and moved toward the base plate 30, the electrically-conductive structure 431 is contacted with the membrane circuit member 33. Consequently, the membrane circuit member 33 is electrically conducted to generate a triggering signal. According to the triggering signal, a corresponding input operation or control operation is performed.

As mentioned above, the height H1 of the first protrusion structure 31 (or the height of the second protrusion structure 32) and the movable depths of the keycap 20 and the third magnetic element 43 within the accommodation space 10*a* are specially designed according to the influence ranges of the first magnetic force F1 and the second magnetic force F2. As shown in FIG. 5B, the magnetic key is in the depressed state. Even if the third magnetic element 43 is separated from the first magnetic element 41 and the second magnetic element 42 to a certain extent, the first magnetic element 41 and the second magnetic element 42 also provide the attraction forces to pull back the third magnetic element 43. That is, when the depressing force F0 is eliminated, the keycap 20 is driven to be moved away from the base plate 30 in response to the first magnetic force F1 and the second magnetic force F2. Consequently, the magnetic key is returned to the non-depressed state of FIG. 5A.

In some other embodiments, the first magnetic element 41, the second magnetic element 42 and the third magnetic element 43 that are formed of magnets are thinner or the height H1 of the first protrusion structure 31 (or the height of the second protrusion structure 32) is larger. Consequently, while the keycap 20 is depressed, the contact attraction between the third magnetic element 43 and the first magnetic element 41 and the contact attraction between the third magnetic element 43 and the second magnetic element 42 may be released completely. Similarly, in this design, the influence ranges of the first magnetic force F1 and the second magnetic force F2 should be taken into consideration. Consequently, the third magnetic element 43 can be pulled back to the original position where the keycap 20 is not depressed.

In accordance with a feature of the present invention, the third magnetic element 43 is magnetically returned to the original position by the first magnetic element 41 and the second magnetic element 42 according to the lateral or horizontal magnetic forces. Please refer to FIGS. 5A and 5B. When the keycap 20 is not depressed, the first magnetic force F1 and the second magnetic force F2 are perpendicular to the normal direction of the base plate 30. While the keycap 20 is depressed and moved, the first magnetic force F1 and the second magnetic force F2 are inclined with respect to the normal direction of the base plate 30. In other words, the way of magnetically returning the keycap to its original position according to the present invention is not implemented through the magnetic attraction between two vertically stack units along the vertical direction. Consequently, the drawbacks of the conventional technologies (e.g., the increased thickness and volume of the magnetic key) can be effectively solved.

It is noted that numerous modifications and alterations may be made while retaining the teachings of the invention. For example, in another embodiment, the base plate 30 is a flat plate without the first protrusion structure 31 and the second protrusion structure 32. Under this circumstance, the first magnetic element 41 and the second magnetic element 42 are directly fixed on the flat base plate by a hot melt process. For providing sufficient capacity of the accommodation space 10*a*, the first magnetic element and the second magnetic element should be high enough. That is, the height of the first magnetic element and the height of the second magnetic element are larger than the thickness of the third magnetic element 43 in order to facilitate returning the keycap to its original position.

As mentioned above, the function of returning the keycap to its original position is achieved according to magnetic attraction. The magnetic attraction is generated between the magnets. Alternatively, the magnetic attraction between a magnet and a paramagnetic material is also feasible. For example, the paramagnetic material is a metallic material.

In another embodiment, the first magnetic element 41 and the second magnetic element 42 are magnets, and the third magnetic element 43 is made of a paramagnetic material. In another embodiment, the third magnetic element 43 is a magnet, and the first magnetic element 41 and the second magnetic element 42 are made of paramagnetic materials. In another embodiment, the first magnetic element 41 and the second magnetic element 42 are magnets or made of paramagnetic materials, and the third magnetic element 43 comprises plural magnets. Under this circumstance, the plural magnets are arranged in a sheet-like form and unlike poles of these magnets are arranged beside each other. In another embodiment, the third magnetic element 43 is a combination of plural magnets and a paramagnetic material. For example, a metal plate is disposed under the keycap 20 and two magnets are attached on two edges of the metal plate.

Figure 6:
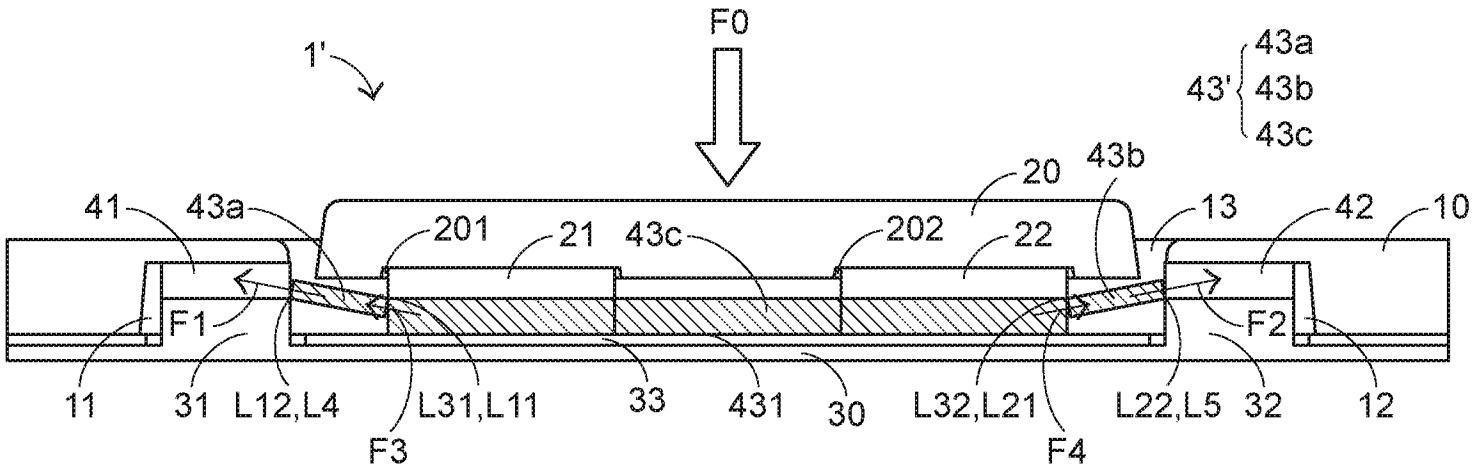
FIG. 6 is a schematic side cross-sectional view illustrating a magnetic key according to another embodiment of the present invention, in which the magnetic key is in a depressed state.

FIG. 6 is a schematic side cross-sectional view illustrating a magnetic key according to another embodiment of the present invention, in which the magnetic key is in a depressed state. Component parts and elements corresponding to those of the above embodiment are designated by identical numeral references, and detailed descriptions thereof are omitted. In comparison with the above embodiment, the structure of the third magnetic element 43' is distinguished. Moreover, the first magnetic element 41 and the second magnetic element 42 are magnets or made of paramagnetic materials. As shown in FIG. 6, the third magnetic element 43' comprises plural magnets 43*a*, 43*b* and 43*c*. The magnet 43*c* is arranged between the magnets 43*a* and 43*b*. In addition, unlike poles of these magnets 43*a*, 43*b* and 43*c* are arranged beside each other. The magnet 43*a* and the magnet 43*b* are smaller than the magnet 43*c*. It is noted that the sizes or thicknesses of these magnets 43*a*, 43*b* and 43*c* may be varied according to the practical requirements.

Please refer to FIG. 6 again. A first magnetic force F1 is generated between the magnet 43*a* and the first magnetic element 41. A second magnetic force F2 is generated between the magnet 43*b* and the second magnetic element 42. A third magnetic force F3 is generated between the magnet 43*c* and the magnet 43*a*. A fourth magnetic force F4 is formed between the magnet 43*c* and the magnet 43*b*. In case that a depressing force F0 exerted on the keycap 20 overcomes these magnetic forces F1, F2, F3 and F4, the keycap 20 can be moved. Since the two magnets 43*a* and 43*b* are independent of the magnet 43*c*, these magnets 43*a*, 43*b* and 43*c* are not completely attracted when the magnetic key is in the depressed state.

Particularly, while the keycap 20 is depressed, the magnet 43*a* is deflected relative to the first magnetic element 41 and the magnet 43*c*, and the magnet 43*b* is deflected relative to the second magnetic element 42 and the magnet 43*c*. A top edge L31 of the magnet 43*c* is connected with a top edge L11 of the magnet 43*a*, and another top edge L32 of the magnet 43*c* is connected with a top edge L21 of the magnet 43*b*. Moreover, a bottom edge L12 of the magnet 43*a* is connected with a bottom edge L4 of the first magnetic element 41, and a bottom edge L22 of the magnet 43*b* is connected with a bottom edge L5 of the second magnetic element 42. When the depressing force F0 is eliminated, the keycap 20 is driven to be returned to its original position in response to these magnetic forces. Consequently, the feedback of depressing the keycap 20 is enhanced.

Moreover, in case that a more precise machining technology is adopted, the magnetic key is only equipped with a positioning element or the magnetic key is not equipped with any positioning element. In case that only a positioning element is provided, the two positioning elements 21 and 22 in the above embodiments are replaced by a larger positioning element and the sizes and shapes of the recesses 201 and 202 are correspondingly modified. In case that no positioning element is provided, the third magnetic element 43 is directly fixed on the bottom surface of the keycap 20 and the recesses 201 and 202 are omitted.

From the above descriptions, the present invention provides a magnetic type keyboard and a magnetic key. Consequently, in comparison with the conventional technologies, the thickness and volume of the magnetic key are effectively reduced. That is, the magnetic type keyboard and the magnetic key can meet the slimness requirement of the applied electronic device. Moreover, the keycap is returned to the original position according to the lateral or horizontal magnetic forces. In comparison with the conventional technologies, the feedback of depressing the magnetic key of the present invention is enhanced. The magnetic type keyboard and the magnetic key can effectively solve the drawbacks of the conventional solve the drawbacks while achieving the purposes of the present invention.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A magnetic type keyboard comprising plural magnetic keys, each magnetic key comprising:

a keycap to be depressed;

a base plate;

a membrane circuit member disposed over the base plate;

a frame disposed over the base plate and the membrane circuit member, and comprising a first concave structure, a second concave structure and an opening, wherein the keycap is movably inserted in the opening, and the frame has an accommodation space;

a first magnetic element disposed on the base plate and received within the first concave structure;

a second magnetic element disposed on the base plate and received within the second concave structure; and a third magnetic element disposed under the keycap and accommodated within the accommodation space, wherein in response to a first magnetic force between the third magnetic element and the first magnetic element and a second magnetic force between the third magnetic element and the second magnetic element, the keycap is driven to be protruded out of the opening, wherein each of the first magnetic element and the second magnetic element is a magnet or made of a paramagnetic material, and the third magnetic element is made of plural magnets, wherein the third magnetic element comprises a first magnet, a second magnet and a third magnet, and unlike poles of the first magnet, the second magnet and the third magnet are arranged beside each other, wherein a first magnet force is generated between the first magnet and the first magnetic element, a second magnetic force is generated between the second magnet and the second magnetic element, a third magnetic force is generated between the third magnet and the first magnet, and a fourth magnetic force is formed between the third magnet and the second magnet, wherein when a depressing force exerted on the keycap overcomes the first magnetic force, the second magnetic force, the third magnetic force and the fourth magnetic force, the first magnet is deflected relative to the first magnetic element and the third magnet, and the second magnet is deflected relative to the second magnetic element and the third magnet.

2. The magnetic type keyboard according to claim 1, wherein when the keycap is not depressed, the third magnetic element is magnetically attracted by the first magnetic element and the second magnetic element, wherein when a depressing force exerted on the keycap overcomes the first magnetic force and the second magnetic force, the third magnetic element is moved relative to the first magnetic element and the second magnetic element and the keycap is moved toward the base plate, wherein when the depressing force is eliminated, the keycap is moved away from the base plate in response to the first magnetic force and the second magnetic force.

3. The magnetic type keyboard according to claim 1, wherein when the keycap is not depressed, the first magnetic force and the second magnetic force are perpendicular to a normal direction of the base plate, wherein while the keycap is depressed and moved, the first magnetic force and the second magnetic force are inclined with respect to the normal direction of the base plate.

4. The magnetic type keyboard according to claim 1, wherein the first magnetic element and the second magnetic element are fixed on the base plate by a hot melt process.

5. The magnetic type keyboard according to claim 1, wherein the base plate comprises a first protrusion structure and a second protrusion structure corresponding to the first concave structure and the second concave structure, respectively, wherein the accommodation space is defined by the frame, the first protrusion structure and the second protrusion structure collaboratively, wherein the first magnetic element is disposed on the first protrusion structure, and the second magnetic element is disposed on the second protrusion structure.

6. The magnetic type keyboard according to claim 5, wherein a height of the first protrusion structure and a height of the second protrusion structure are equal.

7. The magnetic type keyboard according to claim 1, wherein a width of the third magnetic element is equal to a distance between the first magnetic element and the second magnetic element.

8. The magnetic type keyboard according to claim 1, wherein the first magnetic element and the second magnetic element are magnets, and the third magnetic element is made of a paramagnetic material.

9. The magnetic type keyboard according to claim 1, wherein the third magnetic element is a magnet, and the first magnetic element and the second magnetic element are made of paramagnetic materials.

10. The magnetic type keyboard according to claim 1, wherein the first magnetic element, the second magnetic element and the third magnetic element are magnets, and unlike poles of the first magnetic element, the second magnetic element and the third magnetic element are arranged beside each other.

11. The magnetic type keyboard according to claim 1, wherein each magnetic key further comprises at least one positioning element, and the at least one positioning element is made of a paramagnetic material, wherein the at least one positioning element is disposed under the keycap and arranged between the keycap and the third magnetic element, and the at least one positioning element allows the third magnetic element to position the first magnetic element and the second magnetic element.

12. The magnetic type keyboard according to claim 1, wherein an electrically-conductive structure is formed on a bottom surface of the third magnetic element, wherein when the keycap is depressed and moved toward the base plate and the electrically-conductive structure is contacted with the membrane circuit member, the membrane circuit member is electrically conducted to generate a triggering signal.

* * * * *